US011361684B2

(12) United States Patent
Topcuoglu

(10) Patent No.: US 11,361,684 B2
(45) Date of Patent: Jun. 14, 2022

(54) PRODUCTION METHOD FOR A POSTER DEVICE AND POSTER DEVICE

(71) Applicant: M.T Reklam Anonim Şirketi, Gebze/Kocaeli (TR)

(72) Inventor: Ali Topcuoglu, Gebze/Kocaeli (TR)

(73) Assignee: M.T Reklam Anonim Şirketi, Gebze / Kocaeli (TR)

( * ) Notice: Subject to any disclaimer, the term of this patent is extended or adjusted under 35 U.S.C. 154(b) by 0 days.

(21) Appl. No.: 17/049,614

(22) PCT Filed: Apr. 25, 2018

(86) PCT No.: PCT/EP2018/060515
§ 371 (c)(1),
(2) Date: Oct. 22, 2020

(87) PCT Pub. No.: WO2019/206406
PCT Pub. Date: Oct. 31, 2019

(65) Prior Publication Data

US 2021/0241660 A1 Aug. 5, 2021

(51) Int. Cl.

| | |
|---|---|
| ***G09F 15/00*** | (2006.01) |
| ***G09F 15/02*** | (2006.01) |
| ***G09F 7/00*** | (2006.01) |

(52) U.S. Cl.
CPC ..... *G09F 15/0012* (2013.01); *G09F 15/0018* (2013.01); *G09F 15/02* (2013.01); *G09F 7/002* (2013.01)

(58) Field of Classification Search
CPC ... G09F 7/002; G09F 15/0012; G09F 15/0018
See application file for complete search history.

(56) References Cited

U.S. PATENT DOCUMENTS 3,863,372 A * 2/1975 Stilling ..... G09F 13/0413 40/574
4,605,575 A * 8/1986 Auld ..... B29C 41/02 428/14

(Continued)

FOREIGN PATENT DOCUMENTS

EP 1467339 A2 10/2004
EP 2016574 A1 1/2009

(Continued)

OTHER PUBLICATIONS

AAF Urethane Gel Product Sheet (Year: 2007).*

(Continued)

*Primary Examiner* — David R Dunn
*Assistant Examiner* — Christopher E Veraa
(74) *Attorney, Agent, or Firm* — Renner, Otto, Boisselle & Sklar, LLP

(57) ABSTRACT

A production method for a poster device with two boards and a frame as well as a poster device. One permanently fixed board is attached to the frame. The other board is removable and can be removed without tools. The frame may be a snap frame and the removable board may be held by snapping elements of the snap frame. The removable board can be removed after the snapping elements have been opened. The method comprises the following steps: •providing a frame and a permanently fixed board comprising a frame-like groove, •placing the frame and the permanently fixed board horizontally, •pouring a flowable gasket material into the frame-like groove so that the groove is completely filled with the flowable gasket material and the flowable gasket material sticks out from the groove, •solidifying the gasket material in such a way that it will not solidify for at least minutes, preferably for at least 20 minutes, •placing the removable board onto the solidified gasket material, •fixing (Continued)

the removable board. The internal space of the resulting poster device is moisture tight.

20 Claims, 3 Drawing Sheets

(56) References Cited

U.S. PATENT DOCUMENTS 5,815,971 A * 10/1998 Rothe ..... A47G 1/0611 40/718
6,263,604 B1 * 7/2001 Williams ..... A47G 1/06 40/718
2009/0211134 A1 * 8/2009 Topcuoglu ..... G09F 15/0018 40/606.17
2010/0027255 A1 * 2/2010 Chang ..... G02B 6/0093 362/235
2013/0247436 A1 * 9/2013 Tolna ..... A47G 1/0611 40/765
2014/0152890 A1 * 6/2014 Rayner ..... H04N 5/2252 348/376
2014/0278178 A1 * 9/2014 Feig ..... A47G 1/06 702/81
2014/0360068 A1 * 12/2014 Bigoney ..... A47G 1/0605 40/745
2015/0322988 A1 * 11/2015 Busby ..... B64C 1/12 244/131
2017/0368764 A1 * 12/2017 Busby ..... F16J 15/065
2018/0074251 A1 * 3/2018 Berard ..... G02B 5/0242

FOREIGN PATENT DOCUMENTS

WO 97/14131 A1 4/1997
WO 2005/025388 A2 3/2005
WO 2008/057059 A1 5/2008

OTHER PUBLICATIONS

International Search Report and Written Opinion for corresponding International Application No. PCT/EP2018/060515 dated Jul. 7, 2019.

* cited by examiner

PRODUCTION METHOD FOR A POSTER DEVICE AND POSTER DEVICE

This application is a national phase of International Application No. PCT/EP2018/060515 filed Apr. 25, 2018 and published in the English language.

The invention concerns a production method for a poster device with two boards and a frame as well as a poster device. One permanently fixed board is attached to the frame. The other board is removable and can be removed without tools. The frame may be a snap frame and the removable board may be held by snapping elements of the snap frame. The removable board can be removed after the snapping elements have been opened.

The frame and the boards form an internal space. A banner, a poster or the like can be placed between the two boards. At least one board is transparent to see the poster or banner. The removable board is transparent and consists of glass or plastic. Such a poster device is known from EP 1 467 339 B1 as well as EP 2016574 B1.

The internal space of the poster device may be protected from moisture by a frame-like gasket made of an elastic material. The gasket is then located between the two boards or between the removable board and the frame. The gasket is attached to the frame or the permanently fixed board for example by means of an adhesive.

If the removable board is held by snapping elements and the like, the contact pressure with which the removable board is pressed onto the gasket is relatively low. An uneven upper surface of the gasket can therefore cause leaks. Gaskets are therefore used which can be deformed with very little force. Therefore, gaskets made of a foamed material are preferred to avoid leaks due to uneven upper surfaces since a foamed material can be deformed with very little force.

In order to produce such a gasket of a poster device, flowable material is typically applied to the permanently fixed board or to the frame in a frame-like manner. In this case, the flowable material is poured onto the permanently fixed board or a flat surface of the frame. The flowable material is selected so that it foams and cures within a few minutes and is then glued to the permanently fixed board or the frame in order to produce the elastic gasket in a quick and appropriate manner. The gasket is attached to the permanently fixed board or the frame due to adhesive properties of the material. Afterwards, the removable board can be placed on the frame-like gasket which then consists of a cured and foamed elastic material.

It is the object of the invention to improve the state of the art. In particular, the internal space of the poster device should be protected from moisture in a very reliable manner.

The object of the invention is solved by a method comprising the features of claim 1 and a poster device comprising the features of the further independent claim. Preferred embodiments comprise the features of the dependent claims.

The method refers to the production of a poster device which comprises a permanently fixed board which is attached to a frame of the poster device. The poster device comprises a removable board. One of the boards is transparent. The poster device comprises an internal space for a poster or the like.

The production method comprises the following steps:

- providing a frame and a permanently fixed board comprising a frame like groove,
- the permanently fixed board is attached to the frame,
- placing the frame and the permanently fixed board horizontally,

- pouring a flowable gasket material into the frame-like groove so that the groove is completely filled with the flowable gasket material and the flowable gasket material sticks out from the groove,
- solidifying the gasket material in such a way that it will not solidify for at least 10 minutes, preferably for at least 20 minutes,
- placing the removable board onto the solidified gasket material,
- fixing the removable board.

The permanently fixed board is attached to the frame. The frame can consist of one or more elements. The frame can comprise snapping elements as known from EP 1 467 339 B1 or EP 2016574 B1.

"Placing the frame and the permanently fixed board horizontally" means that the primary plane of the board is aligned horizontally. A small amount of liquid on the upper surface of the board would therefore not flow down due to gravity.

After pouring the flowable gasket material into the frame-like groove the groove is completely filled with the flowable gasket material and the flowable gasket material sticks out from the groove. That the flowable gasket material sticks out from the groove is at least possible due to surface tension. Consequently, the volume of the cast flowable gasket material exceeds the volume of the groove at the end of the pouring step.

The flowable gasket material is selected in such a way that it can be solidified. "Solidifying the gasket material in such a way that it will not solidify for at least 10 minutes, preferably for at least 20 minutes" means that solidification is carried out in such a way that the material remains flowable for at least 10 minutes, preferably for at least 20 minutes. This ensures that a sufficient flat upper surface is created. This is also true when the flowable gasket material is viscous.

The flowable gasket material may be selected in such a way that it solidifies at room temperature and atmospheric pressure under normal humidity, for example, within 20 to 40 minutes, for example within 30 minutes. Alternatively, the solidification can be controlled, for example, by controlling the ambient temperature.

After solidification, the gasket material sticks out from the groove and is attached to the groove at least due to adhesive forces. The removable board is then placed on the protruding gasket. Since the protruding upper surface of the gasket is flat, sealing is achieved.

Finally the removable board is fixed. This can be achieved, for example, by using clamps, by closing snap elements of a snap frame and/or by a sticky surface of the gasket. For this reason, the poster device may comprise a snap frame, clamps and/or a sticky gasket surface.

In this way, the internal space of the poster device can be protected from moisture in a very reliable manner without having to provide a high contact pressure or a gasket material which can be deformed with very little force. It is not necessary that the gasket consists of a foam, if the contact pressure is low.

It was found that the width of the frame-like groove influences the result. The frame-like groove should not be too narrow. Therefore, the opening of the frame-like groove should be at least 3 mm wide, preferably at least 5 mm in order to achieve an upper surface of the gasket which is completely flat. For space reasons, the width should not exceed 10 mm. For these reasons, a width of 4 to 8 mm is preferable. More preferable is a width of 5 to 7 mm. Further, a groove depth of 1 to 2 mm is sufficient.

Preferably, the flowable gasket material is a gel. At the beginning, this material is viscous so that it can be poured into the frame-like groove. The material is selected in such a way that it can solidify. When solidified, the material is no longer flowable. Such a gasket is free of pores and does not consist of a foamed material.

A polyurethane gel has been found to be particularly suitable for perfectly sealing the problematic transition between the gasket and the removable board.

Polyurethane gels are known elastomers which are commonly used in divers applications such as coatings, absorbent pads and vibration dampening inserts, footwear insoles and electronic component packaging. Their structure is a segmented copolymer consisting of soft segments (typically featuring polyether or polyester backbone) and hard segments. The urea or urethane linkages deriving from the isocyanate component are the main constituents of the hard segments. Phase separation occurs in these polymers due to the thermodynamic incompatibility between the hard and the soft segments. The extent of the phase separation and the ratio of hard to soft segments have direct impact on the physical and mechanical properties of the PU elastomers. Polyurethane gels are considered as a special class of polyurethane elastomers, characterized by a very low hardness, namely be a very low ratio of hard to soft segments (see Y. Srivastava et al., PU Magazine Vol. 12, No. 1, February/March 2015, p. 1-8).

The inventors have identified a specific polyurethane system and a method of manufacturing said system which is particularly suitable for the desired flowable gasket.

Preferably, according to the invention one or more polyurethane precursors (i.e. polyols) are admixed in a predetermined ratio. Examples for suitable polyols are Polyol ST 81027, a slow polyurethane system for gel according to ISO 5008, and Polyol ST 3046, a semi-expanded polyurethane polymer for gasket production, both manufactured by SETKIMYA, Turkey. These polyols, for instance, have different viscosities such as 700 to 500 mPas and 1000 to 1200 mPas (IZO), respectively.

In a first step the polyols are mixed, usually manually, and the temperature of the polyol mixture and the temperature of the frame are preferably adjusted to be approximately the same. The mixing ratio of both polyols can be determined so as to obtain the desired degree of foaming, softness of the obtained gasket, and adhesion of the obtained polyurethane gel at the frame. The mixing ratio of Polyol ST 91027 and Polyol ST 3046 is preferably 7:3.

The polyol or mixture of polyols is then fed to the polyol tank of the machine used for applying the polyurethane on the frame. An appropriate isocyanate, preferably POLYOL ST 3046-Isocyanate 5008 of SETKIMYA, is fed to the isocyanate tank of said machine, and the mixing ratio of polyols and isocyanate is appropriately adjusted by the valve aperture of the tanks.

The valves generally can be controlled from 0 to 100%. If they are opened 100%, usually the outflow amount is too large. Preferably, the valve for feeding polyol mixture is controlled to be 55% and the valve for the isocyanate is controlled to 28%. The polyols and the isocyanate are thus admixed using the mechanical mixer which is integrated in the machine, and the mixture is then directly applied to the frame.

By the mixing ratio in this second step reaction time, temperature effect and hardness can be controlled to desired values. By the mixing speed the mixture of polyol and isocyanate is controlled, which influences strongly the quality and uniformity of the outflow. Temperature effect means that the time until drying and solidifying can be set by selecting the temperature.

If a poster comprises two internal spaces for a poster, it is necessary to dry respectively to solidify the gasket material for one of the two internal space first. Afterwards, it is possible to produce the the next gasket for the second internal space by pouring a flowable gasket material into the frame-like groove belonging to the second internal space so that the groove is completely filled with the flowable gasket material and the flowable gasket material sticks out from the groove. It is then possible to dry respectively to solidify the gasket material belonging to the second internal space. The applied polyisocyanate is soft with a sticky even surface.

In an embodiment of the invention, the frame and the permanently fixed board are two different parts and the frame-like groove runs along the frame. The production effort is low and a particularly large internal space can be provided.

Preferably, the frame comprises one or more aluminum profiles.

The boards are preferably made from plastic and/or glass. Polycarbonate or polyacrylate are preferred plastic materials.

In an embodiment of the invention, the frame comprises snapping elements. The removable board is held by the snapping elements of the frame.

The invention also refers to a poster device comprising a frame and a permanently fixed board which is attached to the frame and a removable board, wherein one of the boards is transparent and wherein the poster device comprises an internal space for a poster or the like and wherein the internal space is protected from moisture by a frame like gasket. The frame-like gasket is attached to a frame-like groove. The groove may be widened to the bottom to hold the seal.

Such a device can be manufactured according to the method described above. The internal space can be protected from moisture in a perfect manner.

In a preferred embodiment, the frame-like gasket comprises a sticky surface. The removable board can be bent elastically. The removable board sticks to the frame-like gasket to protect the internal space from moisture in a perfect manner. The board can be fixed only because of the sticky surface. Further fasteners are not required to provide a perfect seal and to fix the board permanently and reliably. Since the board can be bent elastically, it can be removed from the sticky surface without damaging the board.

In an embodiment of the invention, the removable board consists of an elastic plastic and is not thicker than 0.5 mm, preferably not thicker than 0.3 mm. The removable board is then sufficiently elastic and flexible so that it can be removed from the sticky surface without damaging the removable board.

Preferably, the removable board is at least 0.1 mm thick. More preferably, the removable board is at least 0.2 mm thick. The board is then self-supporting. In other words, when the board is raised, it bends only slightly due to its own weight.

Preferably, the permanently fixed board is at least 3 mm thick. More preferably, the permanently fixed board is at least 4 mm thick. A stable back side is then available for the poster.

Preferably, the permanently fixed board is much thicker than the removable board.

Preferably, the permanently fixed board consists of two layers joined together by ribs to save weight.

In an embodiment of the invention, the two layers as well as the ribs are not thicker than 0.5 mm, preferably not thicker than 0.3 mm. Preferably, the the two layers as well as the ribs are at least 0.1 mm thick. More preferably, the the two layers as well as the ribs are at least 0.2 mm thick. Preferably, the ribs are thicker then the layers. Preferably, the layers and the ribs are made of plastic.

The gasket of the poster device may consist of a solidified gel.

The gasket of the poster device may consist of a polyurethane gel.

The frame-like groove may run along the frame.

Preferably, the frame comprises one or more aluminum profiles.

In an embodiment of the invention, the boards are made from plastic and/or glass.

The frame may comprise snapping elements. In this case, the removable board is preferably held by the snapping elements. The border of the removable board held and covered by the snapping elements to protect the edge of the removable board.

In an embodiment of the invention, the permanently fixed board is held in a lateral groove of the frame.

In an embodiment of the invention, the gasket has a sticky surface in order to solve the object of the invention in a better manner.

These and other features of the present invention will become more apparent from the following description of the illustrative embodiments.

Figure 1:
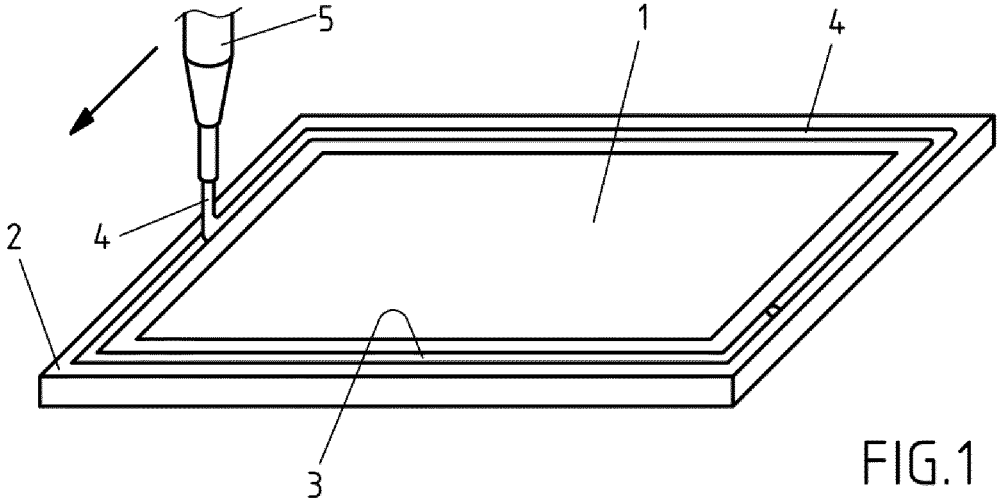
FIG. 1 illustrates pouring of a flowable gasket material into a frame-like groove.

FIG. 1 shows a permanently fixed board 1 which is attached to a frame 2. The frame 2 comprises a frame-like groove 3. The frame-like groove 3 runs as a rectangle in a frame-like manner. The frame 2 and the permanently fixed board 1 are placed horizontally. A flowable gasket material 4 is poured into the frame-like groove 3 so that the frame-like groove 3 will be completely filled with the flowable gasket material 4. In addition, the flowable gasket material 4 sticks out from the frame-like groove 3. During casting, the head 5 of a casting machine is moved parallel to the frame-like groove 3, as indicated by an arrow.

When the frame-like groove 3 is completely filled with the flowable gasket material 4, solidifying of the gasket material 4 will take place in such a way that it will not solidify for at least for at least 20 minutes. Preferably, solidification will take place within 40 minutes.

As soon as the gasket material 4 has solidified, a removable board is placed on the gasket. The removable board is then attached to the gasket. Since the upper surface of the gasket is completely flat, nearly no contact pressure is required to tightly connect the removable board to the gasket. A sticky surface of the gasket is sufficient to bond the board to the gasket in a moisture-proof manner.

Figure 2:
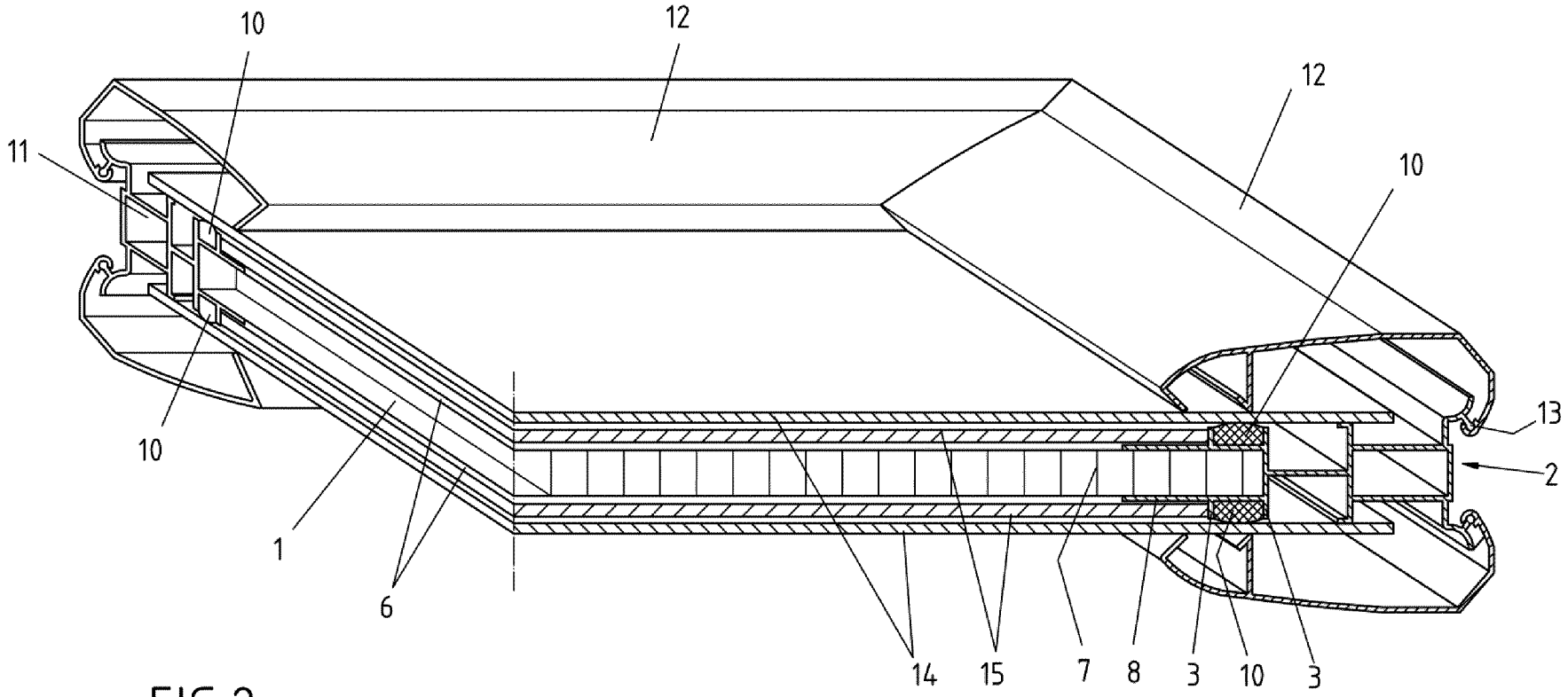
FIG. 2 shows a section of an embodiment of a poster device.

FIG. 2 shows a section of a preferred embodiment of a poster device.

The poster device comprises a frame 2 and a permanently fixed board 1 which is attached to the frame 2. To save weight, the permanently fixed board 1 consists of two thin layers 6 joined together by this ribs 7. The permanently fixed board 1 is mechanically stable and made of plastic. The permanently fixed board 1 extends into a circumferential lateral groove 8 of the frame 2 and is thus held in place. In addition, the permanently fixed board 1 can be glued in the groove 8.

The frame 2 comprises an upper and a lower frame-like groove 3. Both of them run parallel to the frame 2. Both frame-like grooves 3 are circumferential grooves. Both frame-like grooves 3 are filled with a circumferential gasket 10. Each gasket 10 protrudes from its frame-like groove 3 and consists of a polyurethane gel. The surface of both gaskets 10 is sticky. The top area of each gasket 10 is completely flat.

Figure 3:
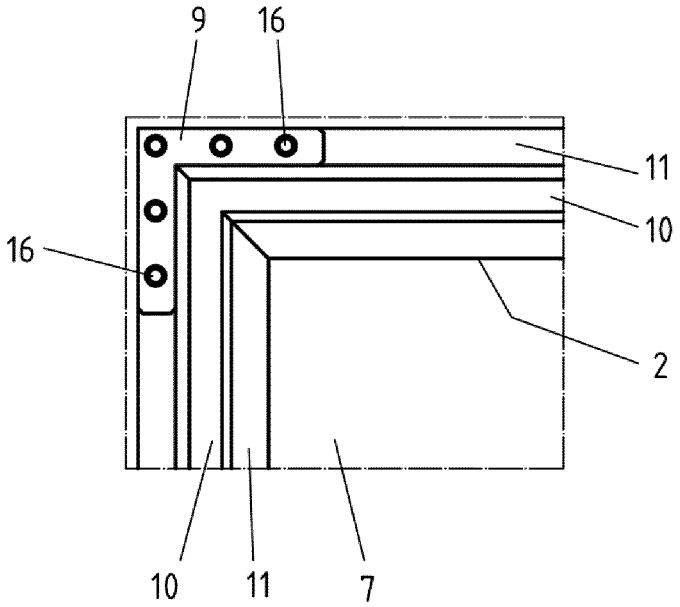
FIG. 3 is a top view on a corner connection of the frame.

The frame 2 consists of four aluminum longitudinal profiles 11 joined together by corner connectors 9 which are shown in FIG. 3. Four snapping elements 12 are hinged to the four aluminum longitudinal profiles 11 of the frame 2 by means of hinge joint 13. The snapping elements 12 are made from aluminum profiles. Pre-stressed strip-like springs (not shown) are attached on one side to the snapping elements 12 and on the other side to the aluminum longitudinal profiles 11 in such a manner that the snapping elements 12 can be hold in an opened and closed position by means of the spring. Two opposite sides of the stripe-like springs are held in grooves. In FIG. 2, the snapping elements 12 are in its closed position.

There are two transparent removable boards 14 which are made of plastic. Each removable board 14 is placed on the top area of the corresponding gasket 10. The sticky surface of each top area is sufficient in order to held each removable board 14 and to provide a moisture tight connection between each gasket 10 and the corresponding transparent removable board 14. Each removable board 14 is made of an elastic plastic. Each removable board 14 is thin and is like a self-supporting foil. Each removable board is about 0.2 mm thick.

In addition, the removable boards 14 are attached to the gaskets 10 by the snapping elements 12. As a result, the poster device comprises two moisture tight internal spaces. In every internal space there is a poster 15 which is perfectly protected from moisture.

The permanently fixed board 1 is stiff compared to the removable board 14 and can hardly be bent.

FIG. 3 shows a section of the frame 2 and is a top view on a corner of the frame 2 showing an angular corner connector 9. Two longitudinal profiles 11 are fixed to the longitudinal profiles 11 by means of rivet joints 16. FIG. 3 shows the width of the opening of the frame-like groove. The width of the opening is 6 mm and corresponds with the shown upper width of the gasket 10. The width at the bottom of the frame the frame-like groove 10 is 6.5 mm. The bottom is therefore slightly wider than the opening. The length of the frame-like groove depends on the dimensions of the frame 2.

While the invention has been illustrated and described in detail in the foregoing drawings and description, the same is to be considered as exemplary and not restrictive in character, it being understood that only illustrative embodiments thereof have been shown and described.

The invention claimed is:

1. A method for the production of a poster device which comprises a permanently fixed board which is attached to a frame of the poster device and a removable board, wherein one of the boards is transparent and wherein the poster device comprises an internal space for a poster or the like, comprising the following steps:

providing a frame and a permanently fixed board comprising a groove, placing the frame and the permanently fixed board horizontally, pouring a flowable gasket material into the groove so that the groove is completely filled with the flowable gasket material and the flowable gasket material sticks out from the groove, solidifying the gasket material in such a way that it will not solidify for at least 10 minutes, placing the removable board onto the solidified gasket material, and fixing the removable board.

2. The method according to claim 1, wherein the gasket material is a gel.

3. The method according to claim 1, wherein the flowable gasket material consists of a polyurethane gel.

4. The method according to claim 1, wherein the groove runs along the frame.

5. The method according to claim 1, wherein the frame comprises one or more longitudinal aluminum profiles.

6. The method according to claim 1, wherein the boards are made from plastic and/or glass.

7. The method according to claim 1, wherein the frame comprises snapping elements and wherein the removable board is held by the snapping elements of the frame.

8. The method according to claim 1, comprising the step of solidifying the gasket material in such a way that it will not solidify for at least 20 minutes.

9. A poster device comprising a frame, a permanently fixed board which is attached to the frame and a removable board, wherein one of the boards is transparent and wherein the poster device comprises an internal space for a poster or the like, wherein the internal space is protected from moisture by a gasket so that the internal space is moisture-proof, wherein the gasket is attached to a groove, wherein the groove is completely filled with the gasket material and the gasket material sticks out from the groove, and wherein the gasket consists of a solidified gel with the removable board placed on the solidified gel.

10. The poster device according to claim 9, wherein the gasket comprises a sticky surface, the removable board can be bent elastically and the removable board sticks to the gasket.

11. The poster device according to claim 9, wherein the removable board is a self-supporting foil made of plastic.

12. The poster device according to claim 9, wherein the gasket consists of a polyurethane gel or the gasket material comprises polyurethane.

13. The poster device according to claim 9, wherein the gasket is free of pores.

14. The poster device according to claim 9, wherein the groove runs along the frame.

15. The poster device according to claim 9, wherein the frame comprises one or more longitudinal aluminum profiles.

16. The poster device according to claim 9, wherein the boards are made from plastic and/or glass.

17. The poster device according to claim 9, wherein the frame comprises snapping elements and wherein the removable board is held by the snapping elements of the frame.

18. The poster device according to claim 17, wherein the snapping elements are formed from aluminum.

19. The poster device according to claim 9, wherein the width of the opening of the groove is 4 to 8 mm.

20. The poster device according to claim 9, wherein the permanently fixed board consists of two thin layers joined together by ribs.

* * * * *